US009089185B2

(12) United States Patent
Nishiwaki et al.

(10) Patent No.: US 9,089,185 B2
(45) Date of Patent: Jul. 28, 2015

(54) STRUCTURE OF FRONT FOOT PORTION OF SHOE SOLE

(75) Inventors: Tsuyoshi Nishiwaki, Kobe (JP); Kiyomitsu Kurosaki, Kobe (JP)

(73) Assignee: ASICS CORPORATION, Irvine, CA (US)

( * ) Notice: Subject to any disclaimer, the term of this patent is extended or adjusted under 35 U.S.C. 154(b) by 1022 days.

(21) Appl. No.: 12/311,796

(22) PCT Filed: Sep. 26, 2007

(86) PCT No.: PCT/JP2007/068609

§ 371 (c)(1), (2), (4) Date: Apr. 13, 2009

(87) PCT Pub. No.: WO2008/047538

PCT Pub. Date: Apr. 24, 2008

(65) Prior Publication Data

US 2010/0005684 A1 Jan. 14, 2010

(30) Foreign Application Priority Data

Oct. 20, 2006 (JP) ..... 2006-285751

(51) Int. Cl.
*A43B 5/06* (2006.01)
*A43B 13/12* (2006.01)
(Continued)

(52) U.S. Cl.
CPC ..... *A43B 13/026* (2013.01); *A43B 5/06* (2013.01); *A43B 7/1425* (2013.01);
(Continued)

(58) Field of Classification Search
USPC ..... 36/103, 107, 108, 25 R, 28, 30 R, 30 A, 36/31, 35 R, 37
See application file for complete search history.

(56) References Cited

U.S. PATENT DOCUMENTS 6,023,859 A * 2/2000 Burke et al. ..... 36/105
6,199,303 B1 3/2001 Luthi et al.
(Continued)

FOREIGN PATENT DOCUMENTS

EP 0857434 A1 8/1998
FR 2863458 A1 6/2005
(Continued)

OTHER PUBLICATIONS

Supplemental European Search Report for European Patent Application No. EP07828382. Jul. 14, 2011.
(Continued)

*Primary Examiner* — Khoa Huynh
*Assistant Examiner* — Sharon M Prange
(74) *Attorney, Agent, or Firm* — Mintz Levin Cohn Ferris Glovsky and Popeo, P.C.

(57) ABSTRACT

There is provided a structure of a shoe sole that suppresses excessive bending by reinforcing the front foot portion of a sole having a reduced weight. The shoe sole may include a mid sole for absorbing an impact of landing, an outer sole placed under the mid sole and in contact with the ground, and a reinforcement element for suppressing bending of a front foot portion during push-off. The reinforcement element includes a medial reinforcement portion extending in a front-rear direction along a medial side of the front foot portion; a lateral reinforcement portion extending in the front-rear direction along a lateral side of the front foot portion; a connection and reinforcement portion for connecting the medial and lateral reinforcement portions and for providing reinforcement; and a connection portion for connecting the medial reinforcement portion and the lateral reinforcement portion in an area posterior to the connection and reinforcement portion.

22 Claims, 12 Drawing Sheets

(51) Int. Cl.

| | |
|---|---|
| ***A43B 13/14*** | (2006.01) |
| ***A43B 13/18*** | (2006.01) |
| ***A43B 13/20*** | (2006.01) |
| ***A43B 13/02*** | (2006.01) |
| ***A43B 7/14*** | (2006.01) |
| ***A43B 13/16*** | (2006.01) |

(52) U.S. Cl.

CPC ..... *A43B 7/1495* (2013.01); *A43B 13/12* (2013.01); *A43B 13/122* (2013.01); *A43B 13/127* (2013.01); *A43B 13/141* (2013.01); *A43B 13/16* (2013.01); *A43B 13/181* (2013.01); *A43B 13/183* (2013.01); *A43B 13/187* (2013.01); *A43B 13/189* (2013.01); *A43B 13/20* (2013.01)

(56) References Cited

U.S. PATENT DOCUMENTS

| | | | | |
|---|---|---|---|---|
| 6,412,196 | B1 * | 7/2002 | Gross | 36/102 |
| 6,477,791 | B2 | 11/2002 | Luithi et al. | |
| 6,775,930 | B2 * | 8/2004 | Fuerst | 36/103 |
| 6,915,596 | B2 * | 7/2005 | Grove et al. | 36/100 |
| 6,920,705 | B2 * | 7/2005 | Lucas et al. | 36/25 R |
| 7,062,865 | B1 | 6/2006 | Nordt, III | |
| 7,299,567 | B2 * | 11/2007 | Berend et al. | 36/88 |
| 7,464,489 | B2 * | 12/2008 | Ho | 36/28 |
| 7,493,708 | B2 * | 2/2009 | Crowley, Jr. | 36/28 |
| 7,647,709 | B2 * | 1/2010 | Reilly et al. | 36/30 R |
| 2003/0208929 | A1 | 11/2003 | Lucas et al. | |
| 2004/0049946 | A1 * | 3/2004 | Lucas et al. | 36/28 |
| 2004/0128860 | A1 | 7/2004 | Smaldone et al. | |
| 2004/0181969 | A1 | 9/2004 | Smaldone et al. | |
| 2006/0185191 | A1 * | 8/2006 | Crowley | 36/28 |
| 2007/0193065 | A1 | 8/2007 | Nishiwaki et al. | |

FOREIGN PATENT DOCUMENTS

| | | | |
|---|---|---|---|
| JP | 2000-225002 | A | 8/2000 |
| JP | 2001-7004 | A | 3/2001 |
| JP | 2004-65978 | A | 3/2004 |
| JP | WO 2006/038338 | A1 | 4/2006 |
| JP | 2006-515776 | A | 6/2006 |
| WO | WO-9639061 | A1 | 12/1996 |
| WO | WO 2004/066771 | A1 | 8/2004 |

OTHER PUBLICATIONS

European Search Report and European Search Opinion issued in Application No. EP20120185979 (12185979.7-1655). Jun. 7, 2013.

* cited by examiner 3
2
42
43
Ff
33
42
4
1
L
34
6
11
43
33
42
1
11
3
IN
1
11
42
6
1
11
42
6
1
11
OUT 1
11
3
32
Ff
42
43
33
42
34
1
XIIA
11
L
2
1
11
35
42
33
43
42
37
1
XIIA
11
33
43(5)
42(4)
38
43
33
1
42
11
1
11
IN
OUT
39
3
Fm
36
Fb

STRUCTURE OF FRONT FOOT PORTION OF SHOE SOLE

TECHNICAL FIELD

The present invention relates to a structure of a front foot portion of a shoe sole.

BACKGROUND ART

In recent years, there is proposed a sole having island-like portions obtained by dividing a front foot portion of the shoe sole in the front-rear or medial-lateral direction (for example, the first and second patent documents identified below). Such a sole is easily bent along grooves between the island-like portions.

[First Patent Document] WO 2006/038338 A1

[Second Patent Document] WO 2004/066771 A1

The third patent document identified below discloses a resilient member extending across a sole groove in a front foot portion for reinforcement. The resilient member is placed between the mid sole and the outer sole, and is attached to the lower surface of the mid sole.

[Third Patent Document] Japanese Laid-Open Patent Publication No. 2001-70004

The fourth to sixth patent documents identified below disclose a sole element that connects between the front foot portion and the rear foot portion along the medial side and/or the lateral side. The sole element may regain the energy used for the deformation of the sole.

[Fourth Patent Document] Japanese Laid-Open Patent Publication No. 2000-225002

[Fifth Patent Document] U.S. Pat. No. 6,199,303 B1

[Sixth Patent Document] U.S. Pat. No. 6,477,791 B2

The seventh patent document identified below discloses a sole including a plurality of columnar leg portions in the rear foot portion. In this sole, the leg portions are connected together by a plate provided on the upper surface of the outer sole separate from the mid sole.

[Seventh Patent Document] US 2004/0181969 A1

In the eighth patent document identified below, an outer sole being a wear resistant reinforcement member is provided across a groove in the front foot portion. Such an outer sole will suppress the bending of the sole along the groove.

[Eighth Patent Document] Japanese Laid-Open Patent Publication No. 2004-65978

DISCLOSURE OF THE INVENTION

One object of the present invention is to reduce the weight of the front foot portion of a sole.

Another object of the present invention is to provide a structure of a sole which may suppress excessive bending, thereby improving the running efficiency, by reinforcing the front foot portion of a sole having a reduced weight.

Still another object of the present invention is to prevent the divergence between the direction of push-off of the foot and the direction of travel.

Yet another object of the present invention is to provide a novel structure for the attachment of a compressively deformable member having a large resiliency.

A first aspect of the present invention is directed to a shoe sole, including: a mid sole for absorbing an impact of landing, an outer sole placed under the mid sole so as to be in contact with ground, and a reinforcement element for suppressing bending of a front foot portion during push-off, wherein the reinforcement element is an integral resin part formed in a loop shape, the reinforcement element including a medial reinforcement portion extending in a front-rear direction along a medial side of the front foot portion; a lateral reinforcement portion extending in the front-rear direction along a lateral side of the front foot portion; a connection and reinforcement portion for connecting together the medial reinforcement portion and the lateral reinforcement portion and also for reinforcing the shoe sole; and a connection portion for connecting together the medial reinforcement portion and the lateral reinforcement portion in an area posterior to the connection and reinforcement portion.

With the running speed being constant, excessive bending of the front foot portion increases the ground reaction force. In other words, it leads to an increase in the kick force. Thus, this is not suitable for running efficiently at a constant speed since it increases the loss of energy.

The medial and lateral reinforcement portions suppress excessive bending of the front foot portion. Therefore, the loss of energy is small, resulting in a desirable efficiency in maintaining the speed where one runs at a constant speed.

The sole with reinforcement portions has an increased flexural rigidity, thus allowing for a reduction in weight by reducing the thickness of the mid sole or by forming the mid sole in an island-like pattern.

A reduction in weight cannot be realized if a resin part is provided across the entire surface of the front foot portion or if the resin part is thick. If the resin part is formed in such a shape as a thin bar or a V shape, the resin part is likely to undergo a deflection in the molding process.

With a loop-shaped resin part, the reinforcement portions and the connection portion are bound by one another in the molding process. Therefore, a deflection in the molding process is unlikely to occur even if the part is formed to be thin and in a strip-like shape. Thus, it is possible to reduce the weight.

In a preferred embodiment of the first aspect, the medial reinforcement portion includes an area of a ball of a big toe; the lateral reinforcement portion includes an area of an interphalangeal joint of a little toe; and the connection and reinforcement portion extends diagonally forward from the ball of the big toe, connecting together the medial and lateral reinforcement portions.

The phrase "to include an area" as used herein means that the medial and lateral reinforcement portions extend from the area in the frontward direction, the rearward direction or the front-rear direction so as to suppress the bending of the foot around the area, being the ball of the big toe or the interphalangeal joint. Therefore, a through hole may be formed in the medial and lateral reinforcement portions directly under or in the vicinity of the ball of the big toe or the interphalangeal joint.

When the front foot portion takes off the ground after landing during a forward running, the front foot portion undergoes a bending that bends the diagonal axis extending from directly under the ball of the big toe of the foot toward the tip of the little toe. This bending directs the push-off of the foot in the diagonally forward direction. Therefore, there is a divergence between the direction of push-off and the direction of travel, thereby resulting in a loss of energy.

In the present embodiment, the provision of the connection and reinforcement portion extending along the diagonal axis suppresses the bending of the diagonal axis. Therefore, the divergence is reduced, which also reduces the loss of energy, thereby improving the running efficiency.

Moreover, if there is no reinforcement element present in the area of the tips of the second to fourth toes, the bending of the second to fourth toes is unlikely to be inhibited, thereby allowing for smooth bending of the toes.

A more preferred embodiment of the first aspect includes a first and a second connection and reinforcement portion. The provision of a plurality of connection and reinforcement portions is effective in suppressing a deflection of the resin part and is also effective in suppressing a bending that bends the diagonal axis.

A second aspect of the present invention is directed to a shoe sole, including: a mid sole for absorbing an impact of landing, an outer sole placed under the mid sole so as to be in contact with ground, and a reinforcement element for suppressing bending of a front foot portion during push-off, wherein the front foot portion of the outer sole includes a plurality of first island-like portions spaced apart from one another in a peninsula-like or island-like pattern at least in a front-rear direction of a foot; the front foot portion of the mid sole includes a plurality of second island-like portions spaced apart from one another in a peninsula-like or island-like pattern so as to break continuity of deformation at least in the front-rear direction of the foot; and the reinforcement element is placed between the plurality of second island-like portions in the front-rear direction of the foot, thereby serving to suppress the bending.

The front foot portion including island-like portions formed in a peninsula-like or island-like pattern is effective in reducing the weight of the sole. Moreover, the introduction of variations in terms of material properties and deformation properties among the second island-like portions of the mid sole is effective in designing the shoe depending on the area of the foot and the application of the shoe.

The provision of the reinforcement element extending in the front-rear direction between a plurality of second island-like portions suppresses the bending of the sole along grooves between the second island-like portions. This improves the running efficiency.

In a preferred embodiment of the second aspect, the reinforcement element is placed on an upper surface of the outer sole while being sandwiched between the first island-like portions and the second island-like portions.

In this case, it is preferred that the reinforcement element is spaced apart from a lower surface of the mid sole between the first island-like portions.

The reinforcement element spaced apart from the lower surface of the mid sole as described above is placed at a position that is at a distance from the neutral axis (an axis at the center of a curved beam) of the sole being bent, whereby the reinforcement element is effective in significantly increasing the flexural rigidity of the sole.

Thus, the reinforcement element spaced apart from the lower surface of the mid sole may be parallel to the lower surface of the outer sole, i.e., in a flat-plate shape, or may be slightly curved in an upwardly protruding shape.

The area of the reinforcement element that is curved in an upwardly protruding shape as described above has a small stretch when the sole is bent, whereby there will be no excessive stress.

A third aspect of the present invention is directed to a shoe sole, including: a mid sole for absorbing an impact of landing, and an outer sole attached to a lower surface of the mid sole so as to be in contact with ground, wherein the mid sole includes a main mid sole of a foamed resin, and a rubber-like or pod-like compressively deformable member exposed on a side surface or a back surface of the mid sole; a holding member is provided for holding, in cooperation with the main mid sole, the compressively deformable member in a predetermined area; the main mid sole includes a first main mid sole covering a sole of the foot, and a second main mid sole placed below the first main mid sole; the compressively deformable member is sandwiched between the first main mid sole and the second main mid sole; and the holding member includes an attachment portion secured to a lower surface of the second main mid sole, and an engagement portion extending upwardly from the attachment portion on the side surface of the mid sole.

In this case, the second main mid sole is unlikely to deform, whereby even if the wearer attempts to pull out the compressively deformable member out of curiosity, it will not easily be done.

In a preferred embodiment of the third aspect, the engagement portion is engaged with the compressively deformable member.

According to the embodiment, in cases where the compressively deformable member is placed so as to be exposed on the side surface or the back surface of the sole in order to reduce the impact or enhance the resilient ability, or from an aesthetic point of view, the member is held more stably. In other words, it is possible to prevent the compressively deformable member from popping out. Moreover, even if the wearer, etc., attempt to pull out the compressively deformable member out of curiosity, it will not easily be done.

In a preferred embodiment of the third aspect, the engagement portion is engaged with the second main mid sole.

In this embodiment, the engagement portion is engaged with the second main mid sole, whereby it is possible to prevent the second main mid sole from popping out from the side surface.

In a preferred embodiment of the third aspect, the second main mid sole is provided in the front foot portion, and the compressively deformable member is located both in a medial area and a lateral area of the front foot portion.

In another preferred embodiment, the compressively deformable member is provided at a position of a ball of a big toe of a front foot portion.

This embodiment provides a desirable cushioning for the ball of the big toe pushing off strongly, and also provides the stability by the holding member.

The engagement portion is preferably formed integrally with the reinforcement element.

In such a case, it is not necessary to separately provide the holding member.

While the compressively deformable member may be a rubber-like or pod-like compressively deformable member, it is preferred to use a rubber-like compressively deformable member.

A "rubber-like or pod-like compressively deformable member" is a member capable of accumulating a repulsive force while being deformed when it is compressed, and may include a member with rubber elasticity such as a thermoplastic elastomer or a vulcanized rubber, as well as a pod-like or bag-like member filled with the air, a gel substance, a soft rubber-like elastic member, or the like. Note that a thermoplastic elastomer is a polymer material that exhibits the property of a vulcanized rubber at room temperature but can be plasticized at high temperature so as to be molded by a plastic processing machine.

As used in the present specification, a rubber-like member, i.e., a member that exhibits a rubber-like elasticity, refers to a member that can deform substantially (e.g., a fracture elongation of 100% or more) and that can restore its original shape upon removal of the stress. Typically, in a stress-deflection diagram of such a member, the change in the stress $\rho$ with respect to the change in the deflection $\delta$ increases as the deflection $\delta$ increases.

DESCRIPTION OF THE REFERENCE NUMERALS

Figure 1:
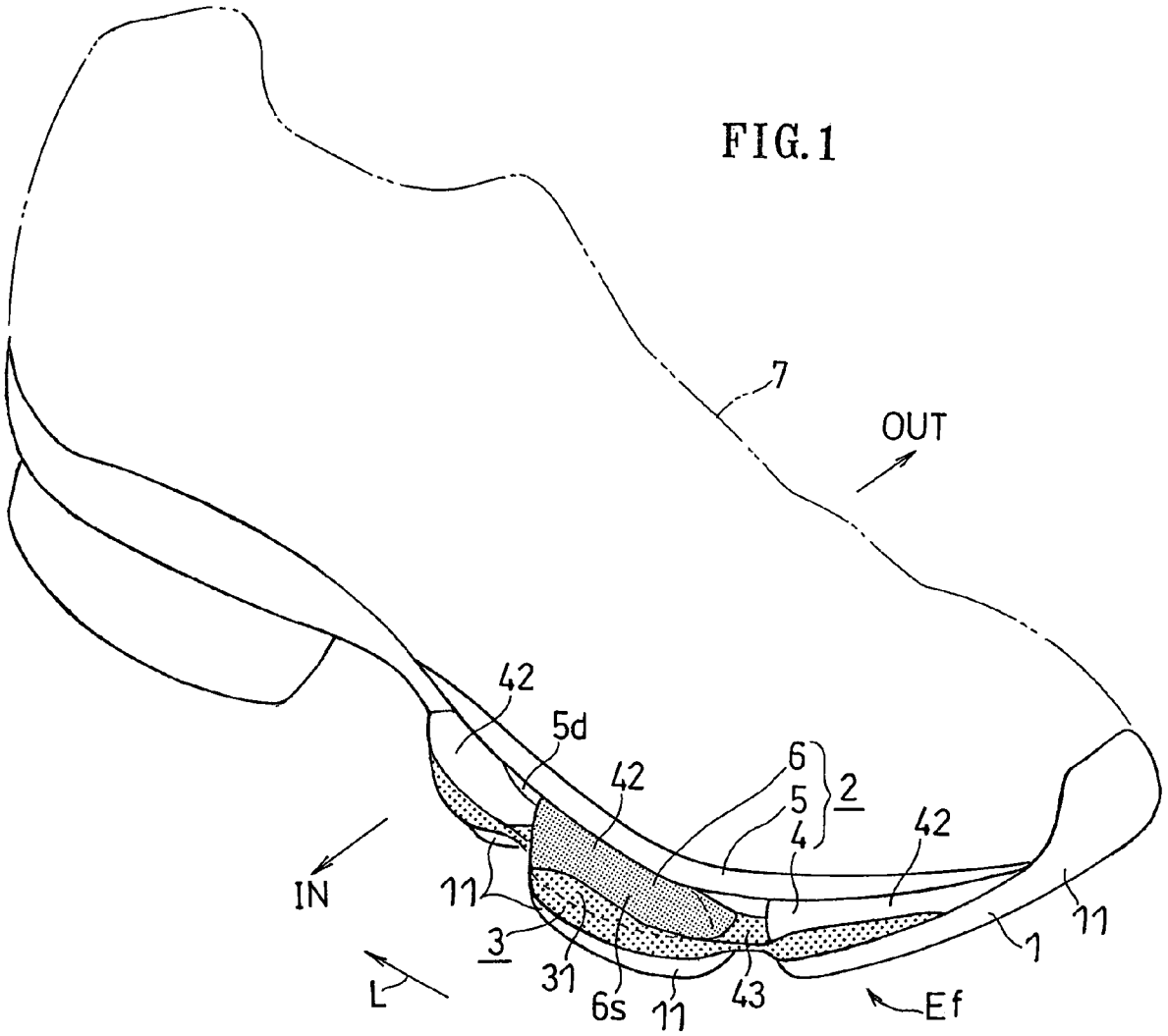
FIG. 1 is a perspective view showing, by a phantom line, an upper of a shoe according to Embodiment 1 of the present invention.

1: Outer sole
2: Mid sole
3: Reinforcement element
4: Second main mid sole
5: First main mid sole
11: First island-like portions
31: Engagement portion
32: Attachment portion
34: Medial reinforcement portion
35: Lateral reinforcement portion
37: First connection and reinforcement portion
38: Second connection and reinforcement portion
39: Connection portion
42: Second island-like portions
$B1_5$: Little toe
Ff: Front foot portion
IN: Medial side
$J_5$: Interphalangeal joint of little toe
O1: Ball of big toe
OUT: Lateral side

BEST MODE FOR CARRYING OUT THE INVENTION

Embodiment 1

Embodiments of the present invention will now be described with reference to the drawings.

FIGS. 1 to 7 show Embodiment 1.

The following description is directed to the structure of the front foot portion, which is a characteristic portion of the present shoe sole.

As shown in FIG. 1, the shoe of Embodiment 1 includes an outer sole 1, a mid sole 2, a reinforcement element 3, and an upper 7 denoted by a broken line.

Figure 4:
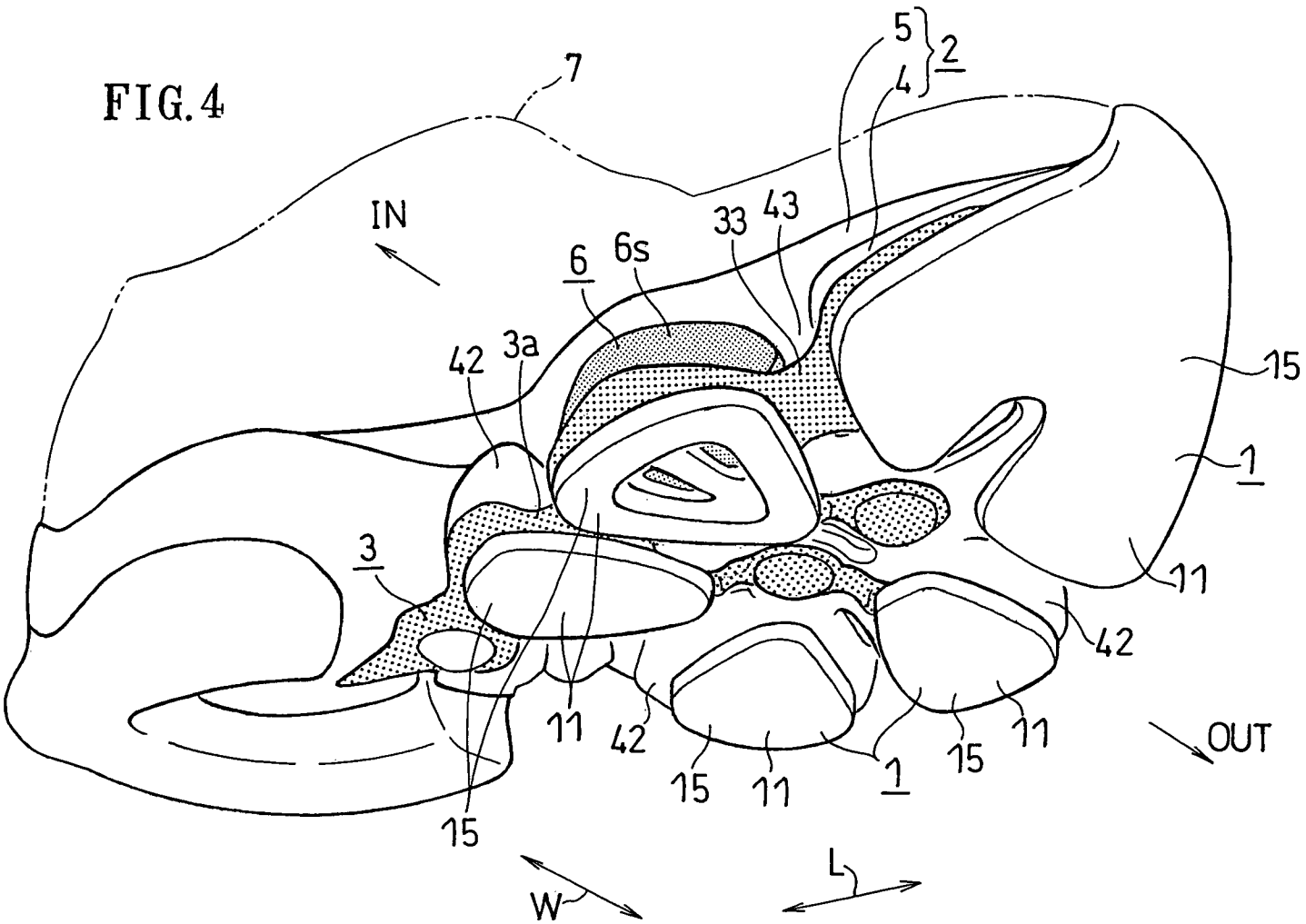
FIG. 4 is a perspective view of the shoe sole as viewed from below.

Outer Sole 1:

As shown in FIG. 4, the outer sole 1 includes five first island-like portions 11 formed in an island-like pattern in the front-rear direction L and the width direction W of the foot. The outer sole 1 is formed by a rubber having a desirable wear resistance against ground contact, and has a tread surface 15 to be in contact with the ground upon landing. The first island-like portions 11 are separated from one another in the front-rear and medial-lateral directions of the foot in the front foot portion Ff.

Figure 2:
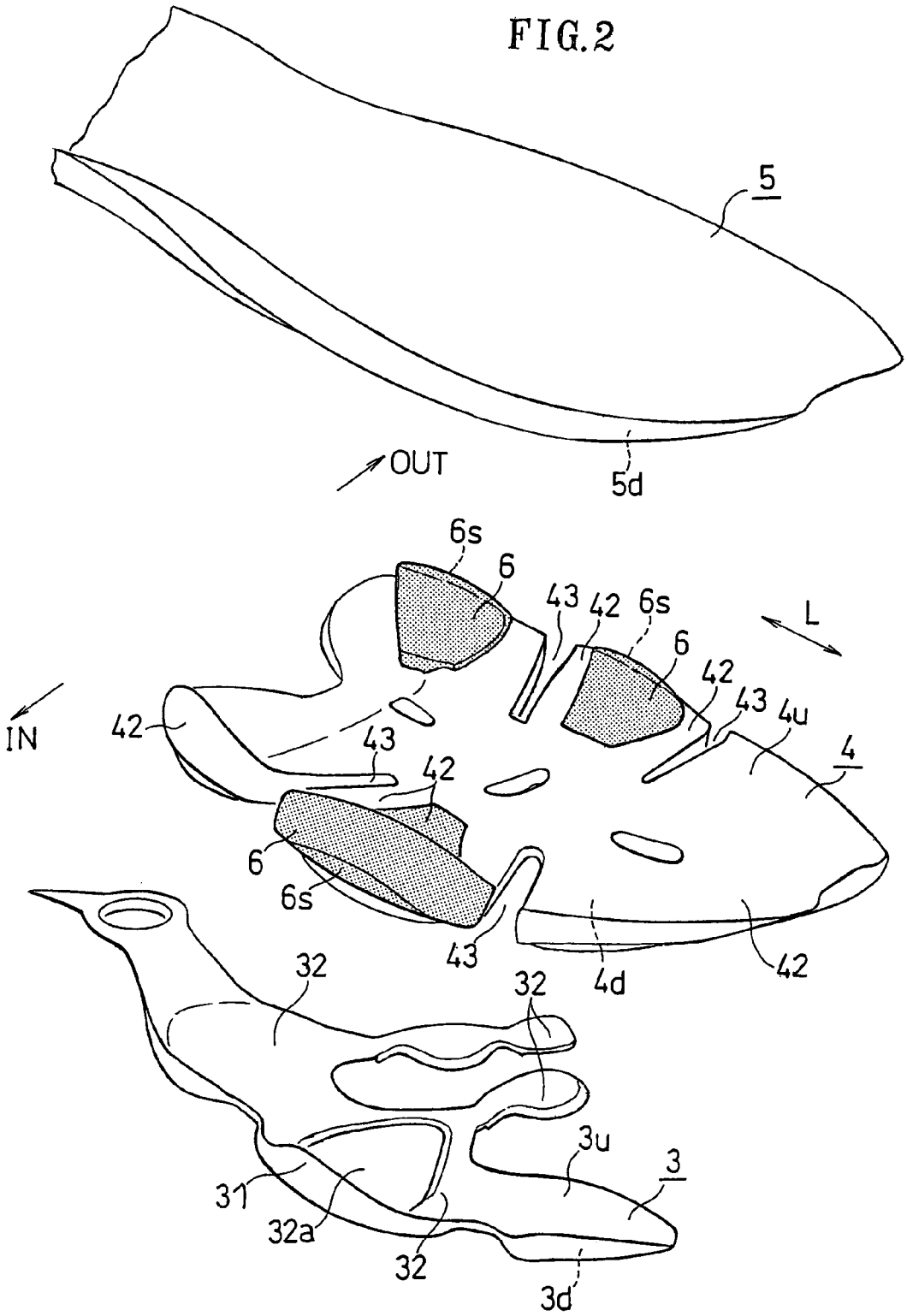
FIG. 2 is an exploded perspective view of a shoe sole of the shoe.

Mid Sole 2:

As shown in FIG. 2, the mid sole 2 includes a first main mid sole 5 covering the sole of the foot, a second main mid sole 4 located under the first main mid sole 5, and compressively deformable members 6.

Figure 3:
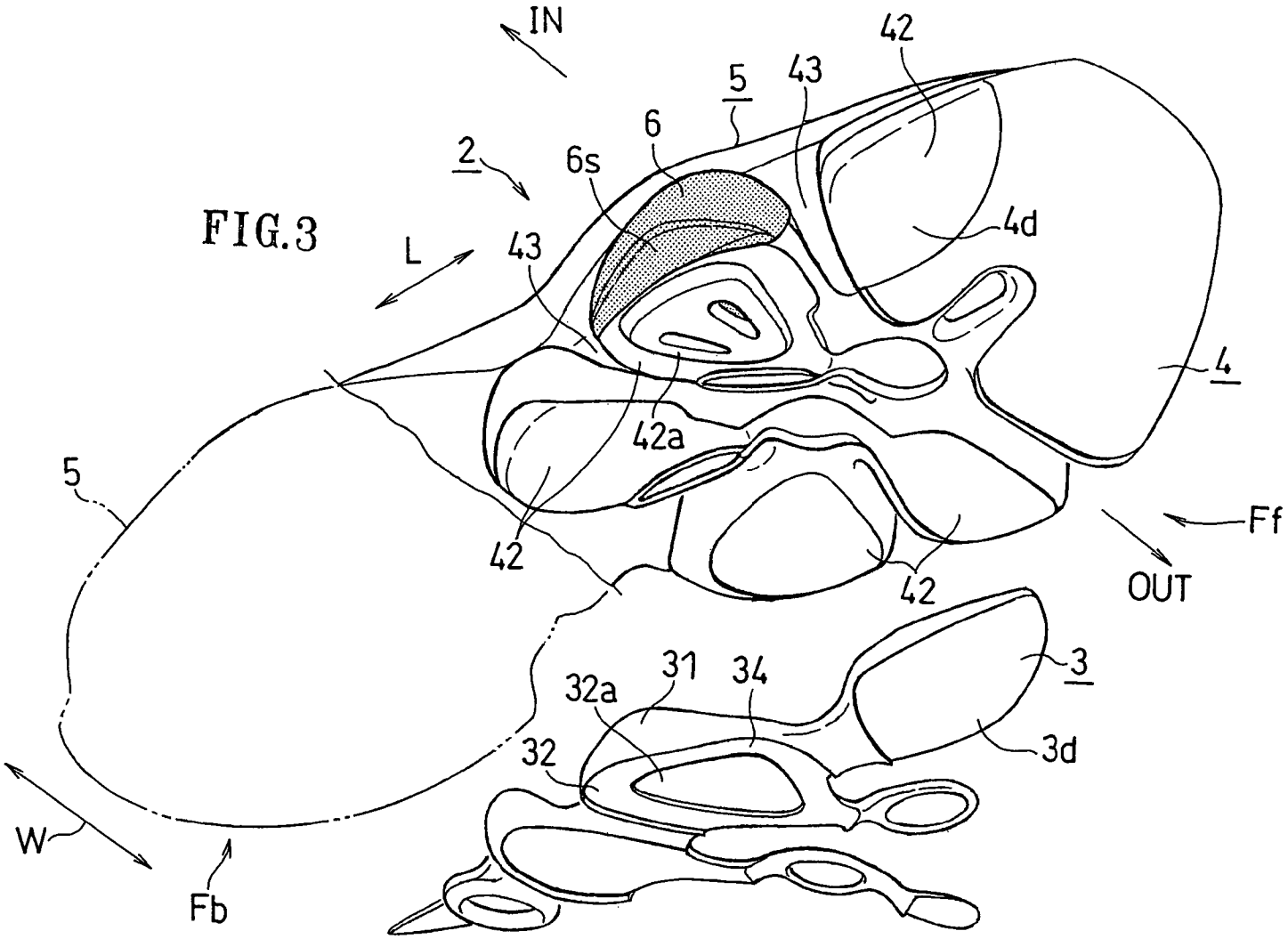
FIG. 3 is a perspective view showing a reinforcement element detached from a mid sole of the shoe sole.

Main Mid Sole:

As shown in FIG. 3, the first main mid sole 5 extends to the rear foot portion Fb denoted by a two-dot chain line. On the other hand, as shown in FIG. 2, the second main mid sole 4 includes, in the front foot portion Ff, five second island-like portions 42 each protruding in a peninsula-like pattern so as to break the continuity of deformation in the front-rear direction L and the width direction W of the foot. Specifically, grooves 43 are formed between the second island-like portions 42 and 42, thereby breaking the continuity of deformation between the second island-like portions 42 in the front-rear direction L. The five second island-like portions 42 are thicker than a central area of the second main mid sole 4, and are protruding more toward the road surface than the central area as shown in FIG. 3. These upper and lower main mid soles 5 and 4 are formed by, for example, a foamed resin such as EVA.

Compressively Deformable Member 6:

In the figures, areas of the compressively deformable members are densely dotted.

In each of the second island-like portions 42, a compressively deformable member 6 is sandwiched between a lower surface 5*d* of the first main mid sole 5 and an upper surface 4*u* of the second main mid sole 4. The compressively deformable member 6 is formed by a rubber-like member. As shown in FIG. 1, the compressively deformable member 6 is exposed toward the outside on the side surface of the mid sole 2.

The formation of the second island-like portions 42 is effective in reducing the weight of the mid sole 2. Moreover, with variations in terms of properties of material that comprises the second island-like portion 42 and deformation properties among the second island-like portions 42, it is possible to increase the freedom of design depending on the area of the foot and the application of the shoe.

Figure 5:
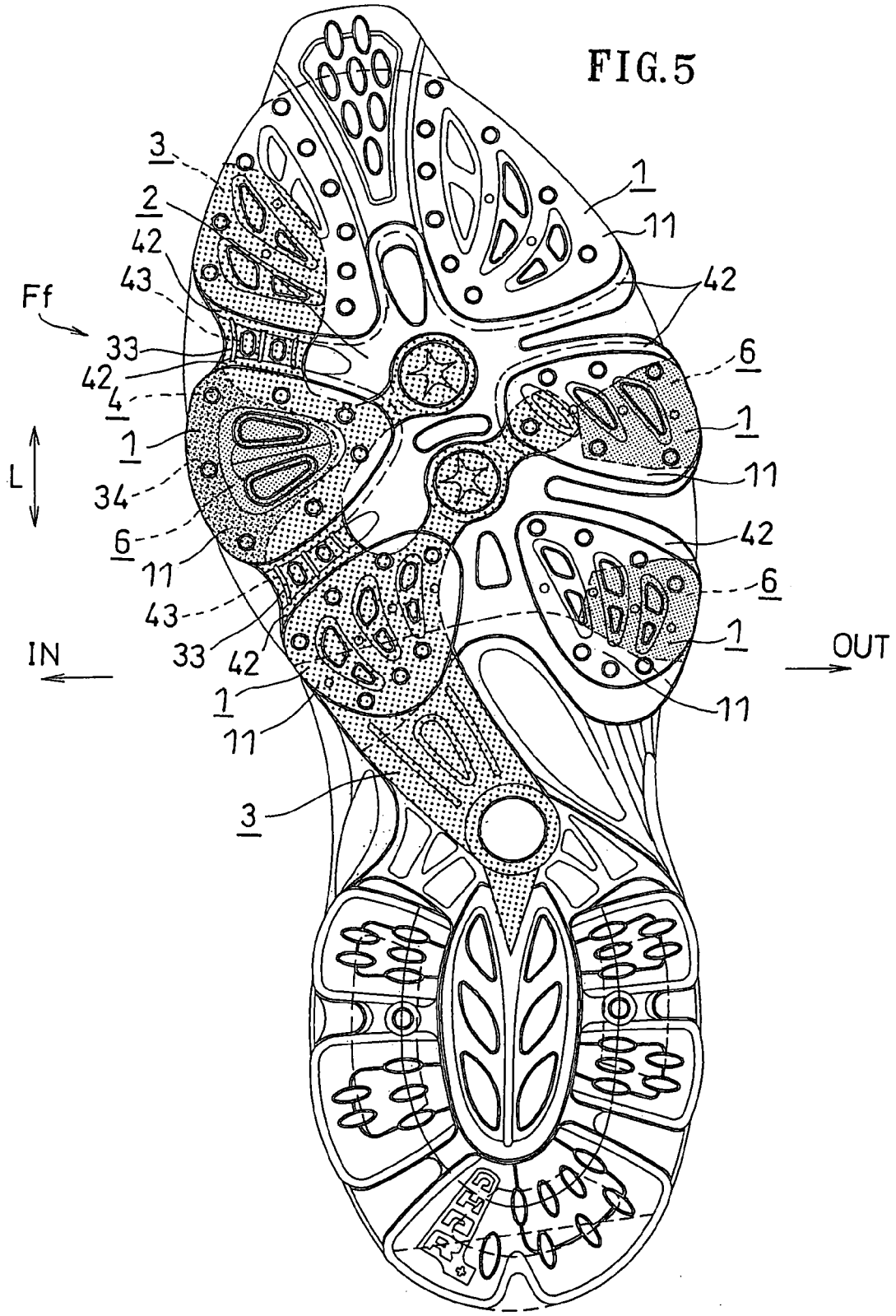
FIG. 5 is a bottom view of the shoe sole.

As represented by the dense dotting in FIG. 5, the compressively deformable members 6 are provided separately on the medial side IN and on the lateral side OUT of the second main mid sole 4. The compressively deformable member 6 provided on the medial side IN is provided in a position directly under the ball O1 of the big toe (see FIG. 9) of the front foot portion Ff. The provision of the compressively deformable member 6 at the ball O1 of the big toe (FIG. 9) improves the cushioning property and the resiliency for the ball O1 of the big toe producing a strong push-off.

Reinforcement Element 3:

The reinforcement element 3 is formed by a non-foamed resin. As represented by the sparse dotting in FIG. 5, the reinforcement element 3 is placed to extend in the front-rear direction L of the foot between the plurality of second island-like portions 42 on the medial side IN of the second main mid sole 4 so as to suppress the bending of the sole along the grooves 43.

As shown in FIG. 3, the reinforcement element 3 has a lower surface 3*d* facing the outer sole 1 (FIG. 4), and an upper surface 3*u*, shown in FIG. 2, opposite to the lower surface 3*d*.

As shown in FIG. 2, an attachment portion 32 to be attached to a lower surface 4*d* of the second island-like portions 42 of the second main mid sole 4 is formed on the upper surface 3*u* of the reinforcement element 3.

Figure 9:
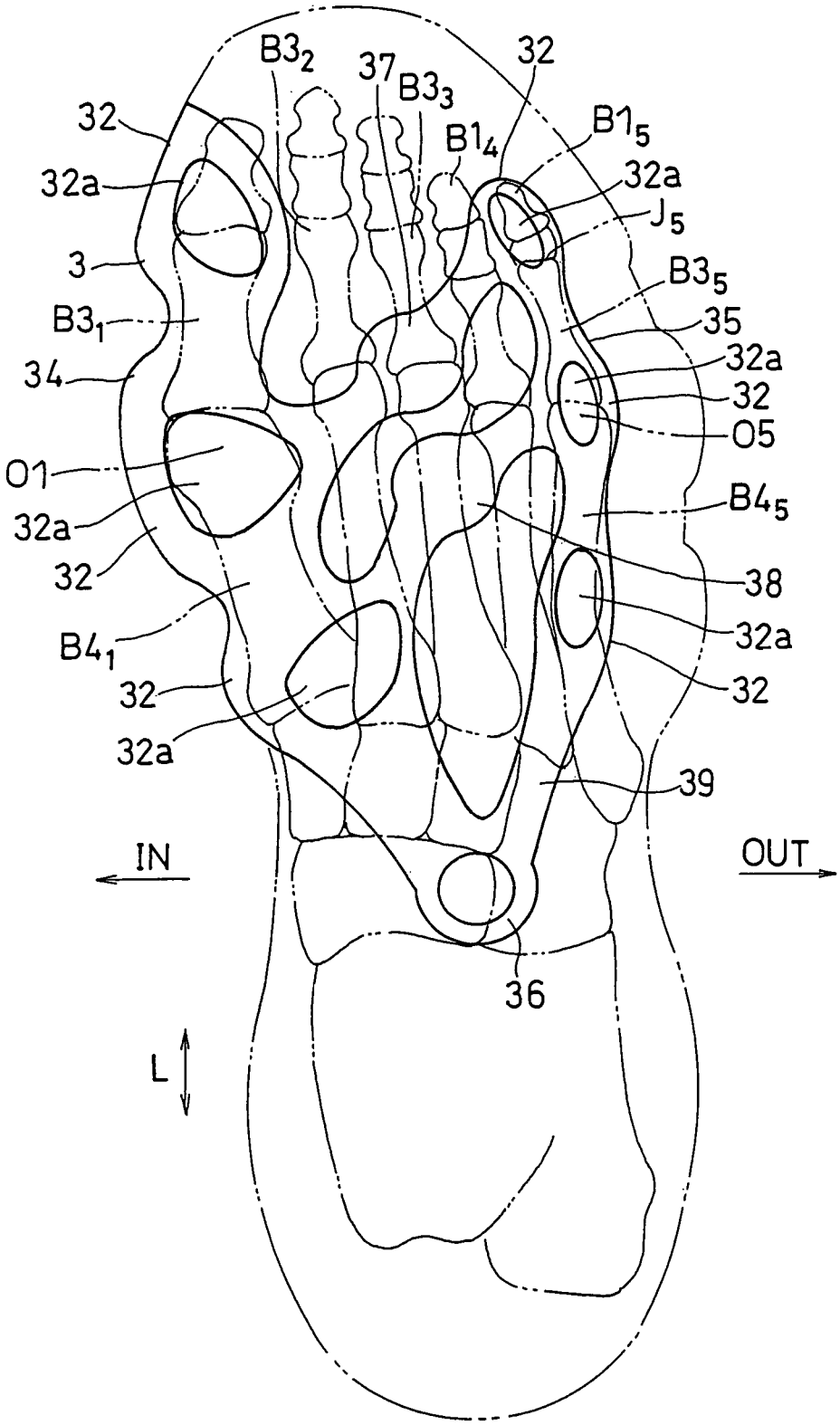
FIG. 9 is a plan view showing the relationship between the reinforcement member and a bone structure of a foot.

A through hole 32*a* is formed in the attachment portion 32 of FIG. 3 provided directly under the ball O1 of the big toe (FIG. 9). A protruding portion 42*a* protruding downward from the second island-like portion 42 fits in the through hole 32*a*.

Figure 6A:
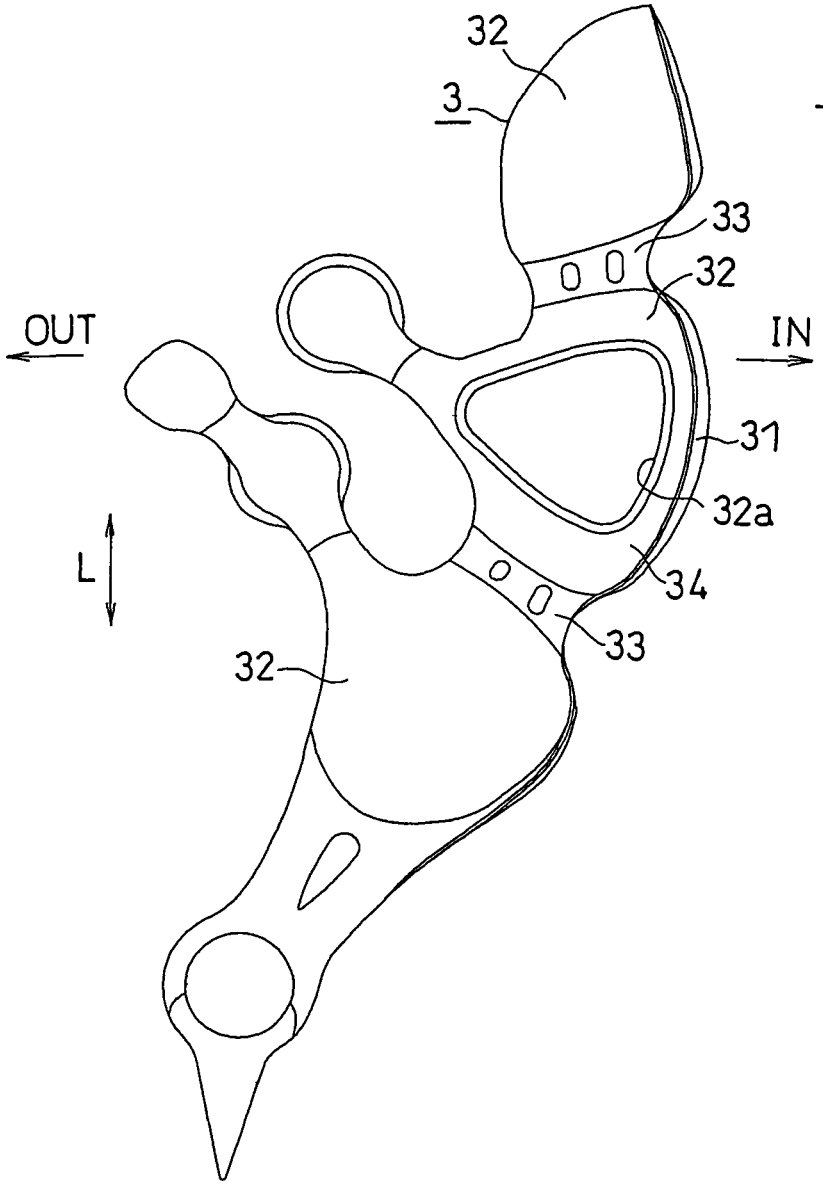
FIG. 6A is a plan view of a reinforcement element.
Figure 7:
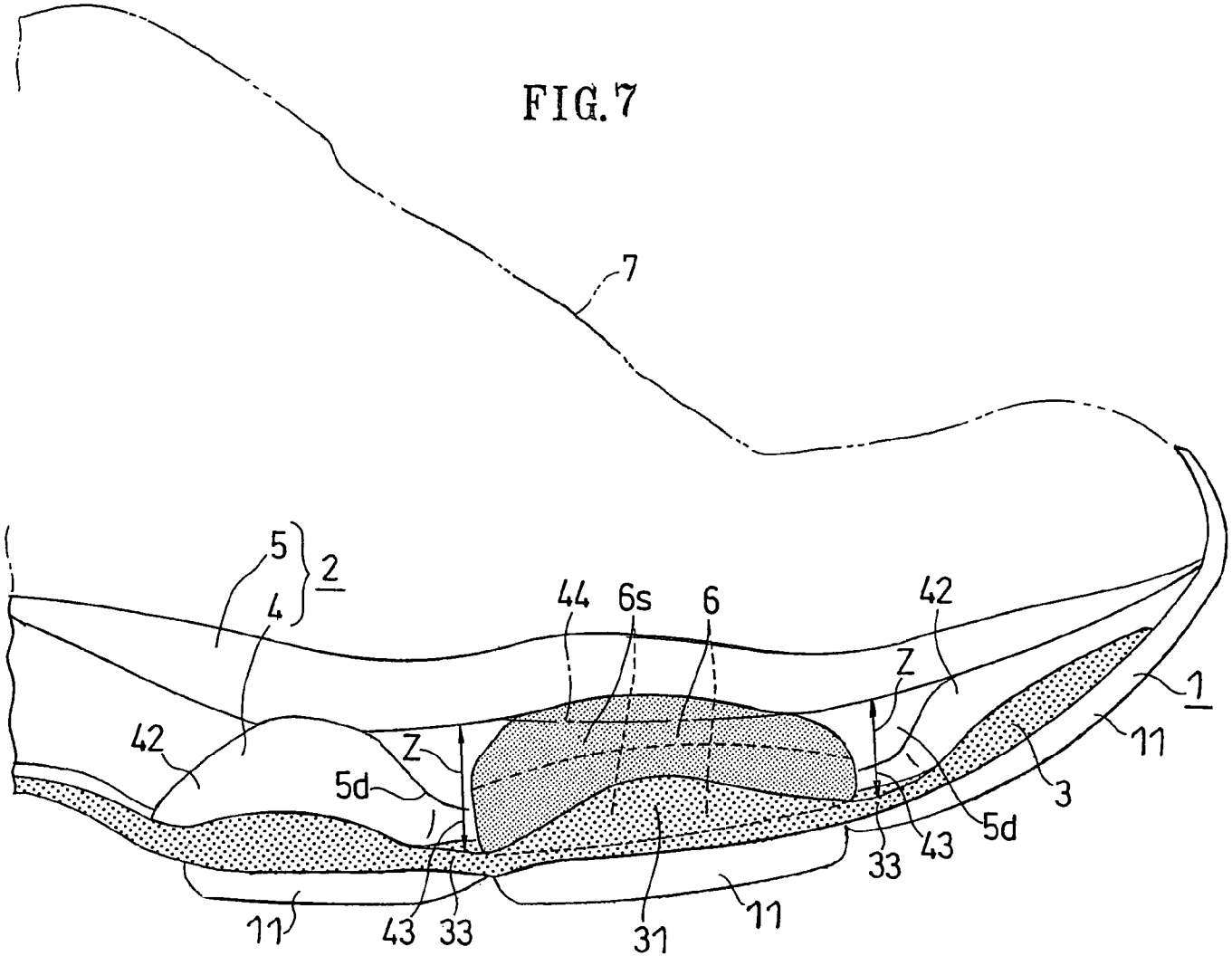
FIG. 7 is a side view of a front foot portion of a shoe sole as viewed from the medial side of the foot.

As shown in FIG. 6A, the reinforcement element 3 includes bending suppressing portions 33 formed between the attachment portions 32 to be bonded to the second island-like portions 42 on the medial side IN (FIG. 3). As shown in FIGS. 4 and 7, the bending suppressing portions 33 are spaced apart from the lower surface of the second main mid sole 4 along the grooves 43 of the mid sole 2.

Thus, the reinforcement element 3 placed to extend in the front-rear direction L between the plurality of second island-like portions 42 suppresses the bending of the mid sole 2 along the grooves 43 between the second island-like portions 42. This improves the running efficiency.

With the bending suppressing portions 33 being spaced apart from the lower surface of the mid sole 2 along the grooves 43, it is possible to suppress excessive bending of the front foot portion Ff without hindering the reduction in weight of the second island-like portions 42 of the mid sole 2.

As shown in FIG. 7, the bending suppressing portions 33 are spaced apart from the lower surface 5*d* of the first main mid sole 5 along the grooves 43 of the second main mid sole 4, and are formed in a flat-plate shape parallel to the lower surface of the outer sole 1.

The reinforcement element 3 spaced apart from the lower surface 5*d* of the mid sole 2 is placed at a position that is at the distance Z from a neutral axis (an axis at the center of a curved beam) 44 of the mid sole 2. Therefore, the reinforcement element 3 is effective in significantly increasing the flexural rigidity of the mid sole 2.

Figure 6B:
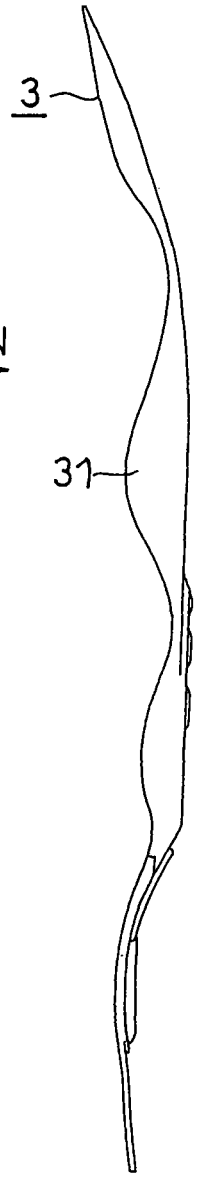
FIG. 6B is a side view thereof.

Engagement Portion 31:

As shown in FIGS. 5 and 6A, the reinforcement element 3 includes a medial reinforcement portion 34 extending in the front-rear direction L along the medial side IN of the front foot portion Ff. As shown in FIGS. 6B and 7, the reinforcement element 3 includes an engagement portion 31 formed so as to rise upward on the medial side of the ball O1 of the big toe (FIG. 9). The engagement portion 31 engages with a lower portion of a side surface 6*s* of the compressively deformable member 6 so as to cover the compressively deformable member 6 from the side, whereby the compressively deformable member 6 is prevented from popping out.

Thus, in a case where the compressively deformable member 6 and the side surface of the mid sole 2 are exposed toward the outside, the provision of the engagement portion 31 stabilizes the fixing of the member 6 to the mid sole 2.

By forming the engagement portion 31 as an integral part of the reinforcement element 3, it is not necessary to separately provide a holding member for holding the compressively deformable member 6.

Embodiment 2

FIGS. 8 to 11 show Embodiment 2.

Figure 8:
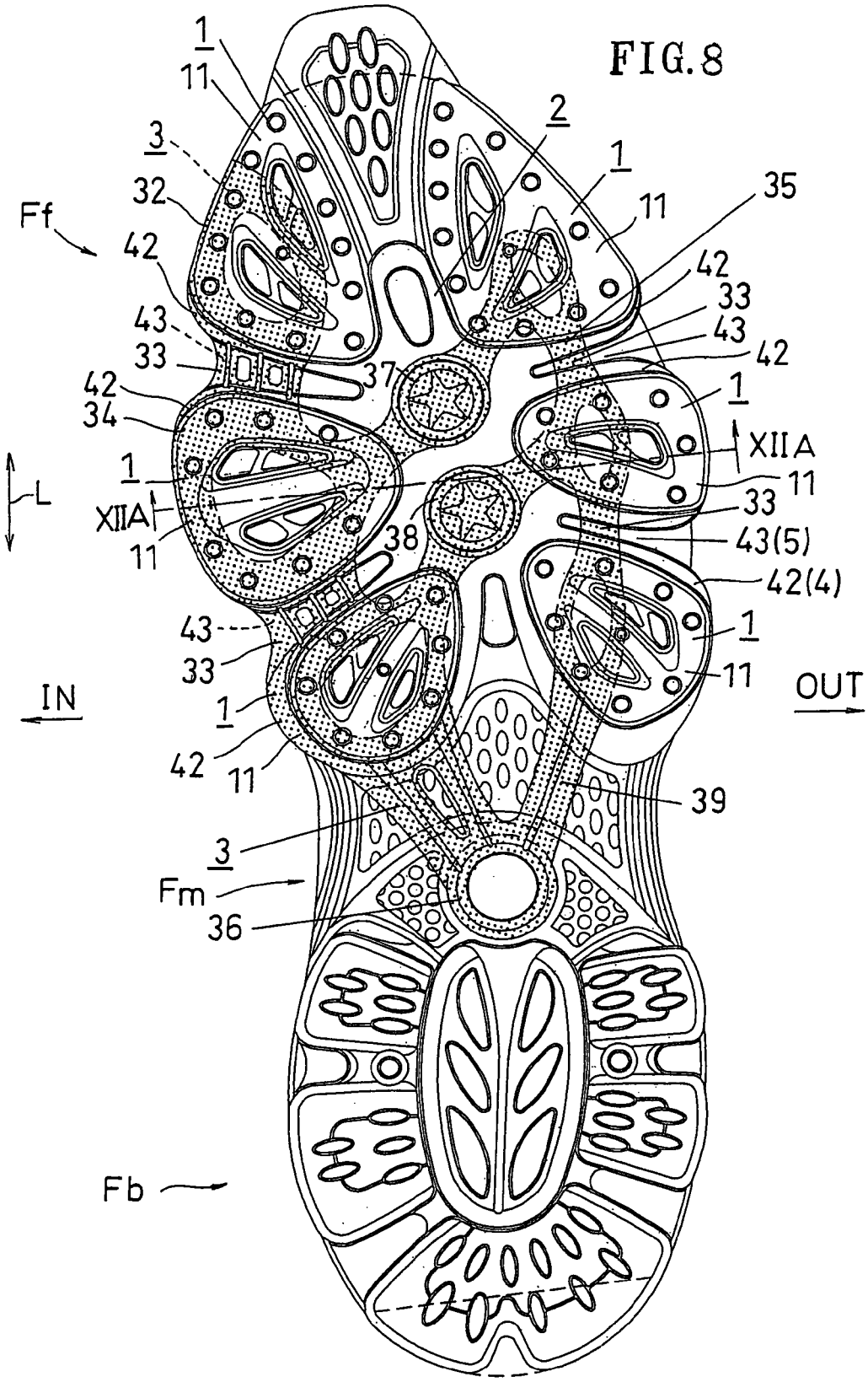
FIG. 8 is a bottom view of a shoe sole according to Embodiment 2.

As represented by the sparse dotting in FIG. 8, the reinforcement element 3 is an integral resin part including the medial reinforcement portion 34, a lateral reinforcement portion 35, a first connection and reinforcement portion 37, a second connection and reinforcement portion 38, and a connection portion 39.

The medial reinforcement portion 34 extends in the front-rear direction L so as to connect together the three second *island-like portions 42 from the tip of the big toe along the medial side IN of the front foot portion Ff.

The lateral reinforcement portion 35 extends in the front-rear direction L so as to connect together the three second island-like portions 42 from the tip of the little toe along the lateral side OUT of the front foot portion Ff.

The "front foot portion" as used herein refers to an area that is anterior to the area Fm (FIG. 8) of the mid foot portion that does not contact the ground.

Figure 10:
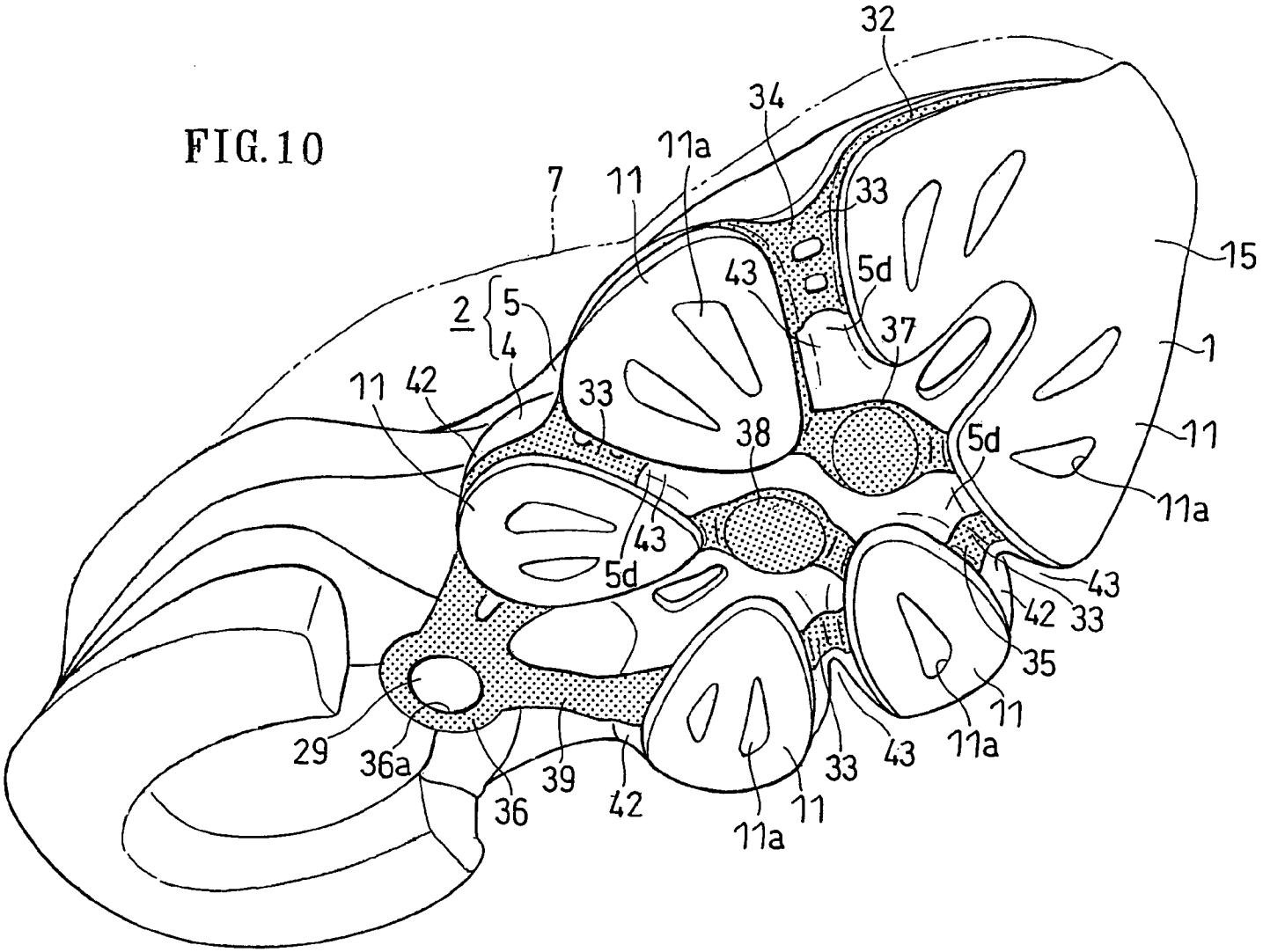
FIG. 10 is a perspective view of a shoe sole.

As shown in FIG. 10, the medial and lateral reinforcement portions 34 and 35 are bonded to the mid sole 2 in the front foot portion Ff. This suppresses bending of the front foot portion, thereby suppressing an increase in the kick force during constant-speed running. As a result, where one runs at a constant speed, the efficiency in maintaining the speed is improved.

Since a greater load acts on the medial side of the foot than on the lateral side, it is necessary to provide a higher rigidity on the medial side to prevent bending. The medial reinforcement portion 34 of FIG. 8 is wider than the lateral reinforcement portion 35. Thus, the medial side has a higher rigidity. As an alternative method, the higher rigidity on the medial side can be realized by making the medial reinforcement portion thicker than the lateral reinforcement portion.

Figure 11A:
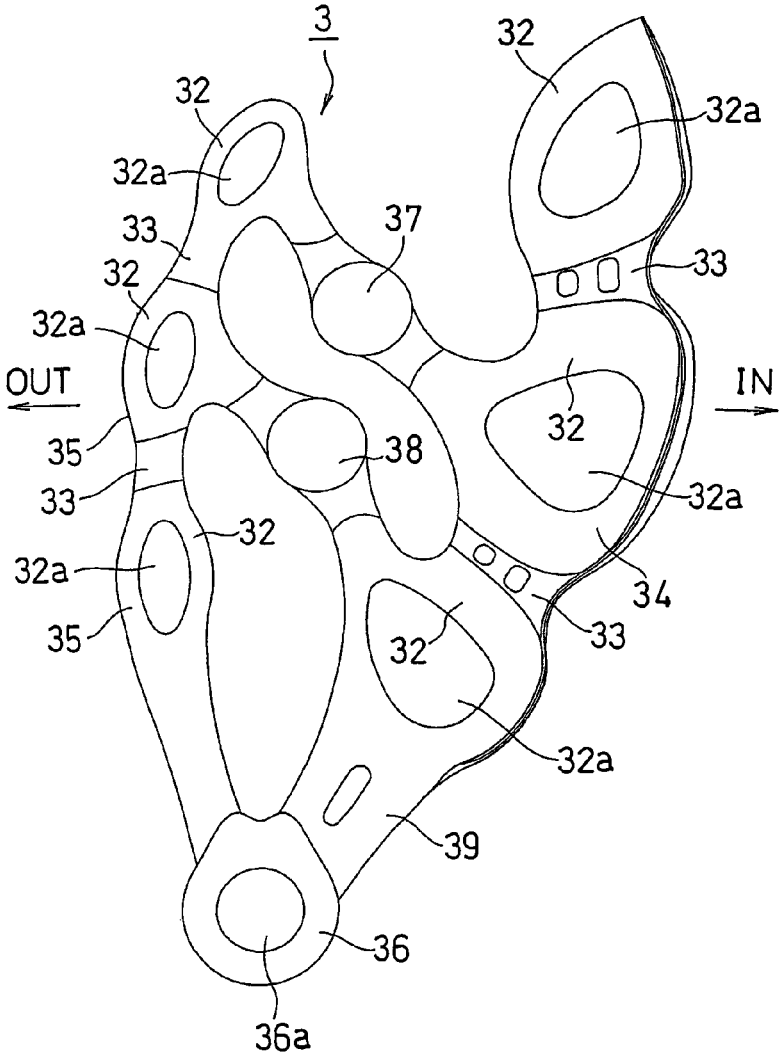
FIG. 11A is a plan view of a reinforcement element.

As shown in FIG. 11A, the through hole 32*a* is formed in each of the attachment portions 32 bonded to the second island-like portions 42 of the mid sole 2. This is for reducing the weight of the reinforcement element 3.

As shown in FIG. 10, small through holes 11*a* are formed in the first island-like portions 11 of the outer sole 1. This is for reducing the weight of the outer sole 1.

Areas such as the ball O1 of the big toe and the ball O5 of the little toe shown in FIG. 9 on the sole of the foot catch the road surface. If the sole corresponding to these areas is hard, it may inhibit the catching of the road surface. In contrast, in the present embodiment, the through holes 32*a* are formed in the attachment portions 32, and the through holes 11*a* are formed in the first island-like portions 11. Therefore, the rigidity of the attachment portions 32 and that of the first island-like portions 11 are reduced. Therefore, the force of the sole of the foot is transmitted to the road surface and the road surface can be caught more easily, thus enabling one to run easily.

The first connection and reinforcement portion 37 connects together the medial and lateral reinforcement portions 34 and 35, and also reinforces the shoe sole. The second connection and reinforcement portion 38 connects together the medial reinforcement portion 34 and the lateral reinforcement portion 35 in the area posterior to the first connection and reinforcement portion 37.

As shown in FIG. 11, the medial reinforcement portion 34 and the lateral reinforcement portion 35 are connected to each other by the V-shaped connection portion 39 at a rear end portion 36 of the reinforcement element 3. Thus, the reinforcement element 3 is formed in a loop shape including the connection portion 39, the first connection and reinforcement portion 37 and the medial and lateral reinforcement portions 34 and 35. Moreover, the reinforcement element 3 is formed in two loops passing through the second connection and reinforcement portion 38.

Thus, by forming the resin reinforcement element 3 in a loop shape, the reinforcement portions 34, 35, 37 and 38 are bound by one another in the molding process. Therefore, a deflection in the molding process is unlikely to occur even if the resin part is formed to be thin and in a strip-like shape. Moreover, the loop-shaped reinforcement element 3 has a desirable shape-retaining property, and is unlikely to be misaligned when being bonded/attached to the sole. Thus, it is possible to reduce the weight of the reinforcement element 3.

The medial and lateral reinforcement portions 34 and 35 and the first and second connection and reinforcement portions 37 and 38 shown in FIG. 10 are bonded to the lower surface of the mid sole 2. On the other hand, the connection portion 39 is not bonded to the lower surface of the mid sole 2 in the area posterior to the most posterior ones of the second island-like portions 42. A through hole 36*a* of the rear end portion 36 fits around a protruding portion 29 protruding from the mid sole 2. The protruding portion 29 is provided on the mid foot portion.

As shown in FIG. 9, the medial reinforcement portion 34 is continuous in the front-rear direction so as to include the area of the ball O1 of the big toe. The lateral reinforcement portion 35 is continuous in the front-rear direction so as to include the area of the interphalangeal joint $J_5$ of the little toe B$\mathbf{1}_5$. The first connection and reinforcement portion 37 extends diagonally forward from the ball O1 of the big toe, connecting together the medial and lateral reinforcement portions 34 and 35.

Thus, the connection and reinforcement portion 37 is provided extending along the first diagonal axis, which extends from directly under the ball O1 of the big toe of the foot toward the interphalangeal joint $J_5$ or the tip of the little toe B$\mathbf{1}_5$, thereby suppressing the bending of the first diagonal axis. Therefore, the divergence between the direction of push-off and the direction of travel is reduced. This also reduces the loss of energy, thereby improving the running efficiency.

As shown in FIG. 9, the reinforcement element 3 is absent in the area anterior to the base of the proximal phalanx B$\mathbf{3}_2$ of the second toe, the shaft of the proximal phalanx B$\mathbf{3}_3$ of the third toe, and the base of the distal phalanx B$\mathbf{1}_4$ of the fourth toe. Therefore, the bending of the second to fourth toes is unlikely to be hindered, allowing for smooth bending of the toes.

The medial reinforcement portion 34 includes the area of the base of the metatarsal bone B$\mathbf{4}_1$ of the big toe. The lateral reinforcement portion 35 includes the area of the ball O5 of the little toe including the base of the proximal phalanx B$\mathbf{3}_5$ of the little toe and the head of the metatarsal bone B$\mathbf{4}_5$ of the little toe. The second connection and reinforcement portion 38 extends diagonally forward from the base of the metatarsal bone B$\mathbf{4}_1$ of the big toe, connecting together the medial and lateral reinforcement portions 34 and 35.

Thus, the second connection and reinforcement portion 38 is provided extending along the second diagonal axis, which extends from the base of the metatarsal bone B$\mathbf{4}_1$ of the big toe of the foot toward the ball O5 of the little toe, thereby suppressing the bending of the second diagonal axis. This further reduces the loss of energy, thereby further improving the running efficiency.

The first island-like portions 11 and the second island-like portions 42 are provided at positions corresponding to the ball O1 of the big toe and the ball O5 of the little toe of FIG. 9 (FIG. 8). The second main mid sole 4 includes the grooves 43 formed anterior to and posterior to the ball O1 of the big toe and the ball O5 of the little toe of FIG. 9 thereby being separated. The second island-like portions 42 are also provided anterior to and posterior to the grooves 43 (FIG. 10). The attachment portions 32 of FIG. 8 are provided corresponding to the second island-like portions 42.

Figure 11B:
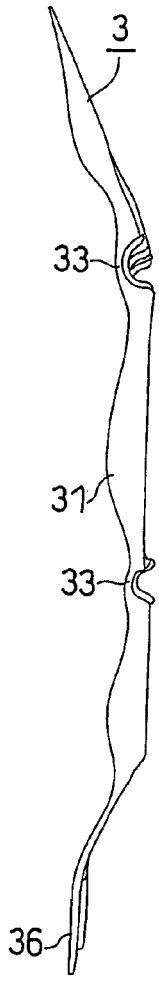
FIG. 11B is a side view thereof.

As shown in FIGS. 10 and 11B, the bending suppressing portions 33 provided between the second island-like portions 42 are slightly curved in an upwardly protruding shape. The bending suppressing portions 33 are narrower with smaller widths than the attachment portions 32, and are attached to the lower surface 5*d* of the first main mid sole 5 along the grooves 43 of the second main mid sole 4. The bending suppressing portions 33 curved in a protruding shape have a small stretch when the mid sole 2 is bent. Therefore, there will be no excessive stress.

Figure 12A:
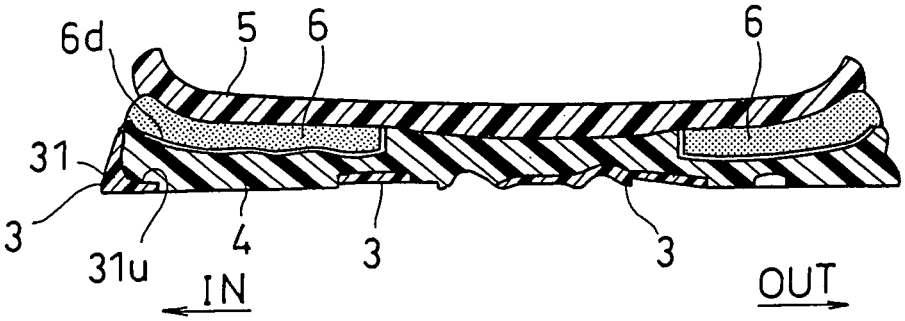
FIG. 12A is a partial cross-sectional view taken along line XIIA-XIIA of FIG. 8.
Figure 12B:
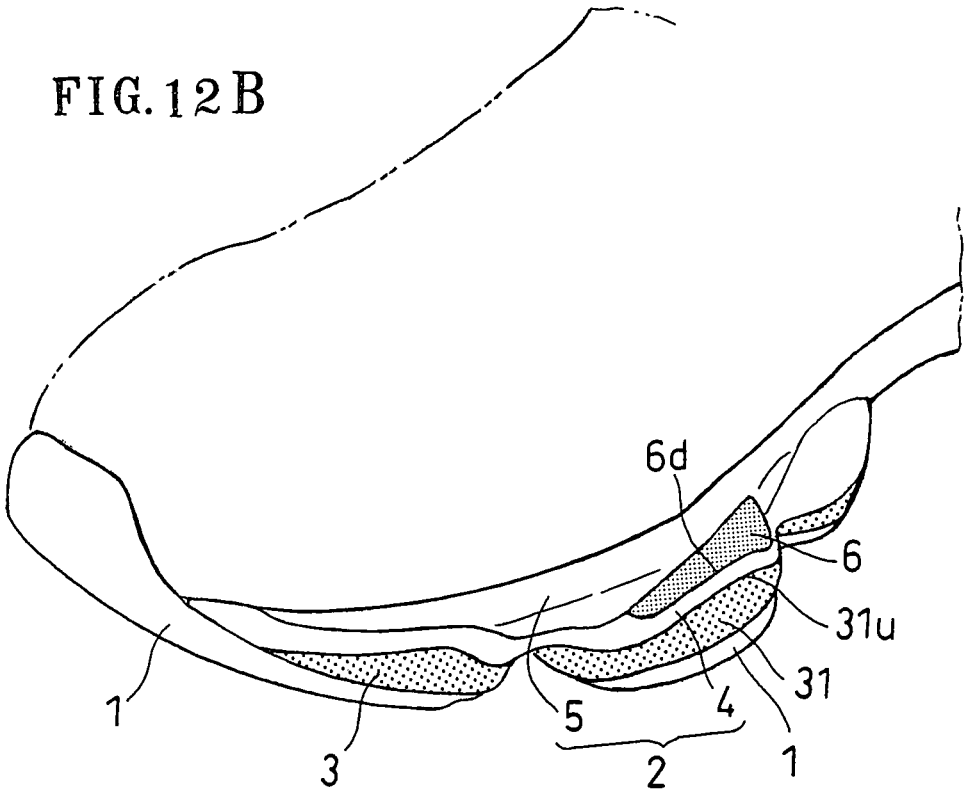
FIG. 12B is a perspective view of a front foot portion of the embodiment.

As shown in FIG. 12A, the second main mid sole 4 is sandwiched between a lower surface 6*d* of the compressively deformable member 6 and an upper surface 31*u* of the engagement portion 31.

The engagement portion 31 is formed so as to rise upward on the medial side of the ball O1 of the big toe (FIG. 9). As a result, the second main mid sole 4 sandwiched between the lower surface 6*d* of the compressively deformable member 6 and the upper surface 31*u* of the engagement portion 31 is engaged with the engagement portion 31 on the medial side IN of the foot. Therefore, when the mid sole is compressed upon landing, the engagement portion 31 prevents the second main mid sole 4 from popping out to the side surface.

The compressively deformable member 6 laminated on the second main mid sole 4 is formed so as to roll up toward the medial side IN of the foot. Since the side surface of the second main mid sole 4 is covered by the engagement portion 31 from the medial side IN, the second main mid sole 4 is unlikely to deform. Thus, even if the wearer attempts to pull out the compressively deformable member 6 out of curiosity, it will not easily be done.

Otherwise, the configuration is similar to that of Embodiment 1, and like elements are denoted by like reference numerals and will not be further described below.

The first island-like portions 11 of the outer sole 1 and the second island-like portions of the second main mid sole 4 may be formed in a peninsula-like pattern.

The compressively deformable member 6 may be formed as a pod-like member.

It is not necessary that the reinforcement element 3 is provided with the engagement portion 31.

The bending suppressing portions 33 curved in a protruding shape may be spaced apart from the lower surface of the mid sole.

INDUSTRIAL APPLICABILITY

The present invention is applicable to the front foot portion structure of the shoe sole of shoes suitable for various kinds of athletic sports.

What is claimed is:

1. A shoe sole, comprising:

a mid sole for absorbing an impact of landing, an outer sole placed under the mid sole so as to be in contact with ground, and a reinforcement element for suppressing bending of a front foot portion of the outer sole and a front foot portion of the mid sole during push-off, wherein:

the front foot portion of the outer sole includes a plurality of first portions spaced apart from one another at least in a front-rear direction of a foot;

the mid sole includes a first main mid sole and a second main mid-sole, the first main mid sole comprising a single layer of foamed resin continuously extending from a medial edge of the mid sole to a lateral edge of the mid sole, the second main mid sole comprising another single layer of foamed resin placed below the first main mid sole, the second main mid sole forming a pair of surfaces extending from one of the medial edge and the lateral edge of the second main mid sole towards a central portion in a width direction of the foot, the pair of surfaces facing each other in the front-rear direction, the pair of surfaces defining a groove extending in the width direction of the foot, the pair of surfaces comprising a front vertical surface and a back vertical surface of the groove;

the front foot portion of the second main mid sole includes a plurality of second portions spaced apart from one another by the groove so as to break continuity of deformation at least in the front-rear direction of the foot, the second portions being continuous with each other in the front-rear direction in at least a part except the groove such that a central portion of the front foot portion in the front-rear direction excludes the groove and is continuous;

the reinforcement element includes a plurarity of third portions attached to an upper surface of the outer sole and sandwiched between the first portions and the second portions; and the reinforcement element includes a bending suppressing portion placed and extending between the third portions in the front-rear direction of the foot, thereby serving to suppress the bending.

2. A shoe sole according to claim 1, wherein the reinforcement element is spaced apart from a lower surface of the first main mid sole between the first portions.

3. A shoe sole according to claim 1, wherein the reinforcement element is attached to a lower surface of the first main mid sole and curved in an upwardly protruding shape between the first portions.

4. A shoe sole according to claim 1, wherein:

the mid sole further includes a compressively deformable member exposed on a side surface of the mid sole;

the reinforcement element serves also as a holding member for holding, in cooperation with the first and second main mid soles, the compressively deformable member in a predetermined area; and the holding member includes an attachment portion secured to an upper surface of the outer sole, and an engagement portion extending upwardly from the attachment portion on the side surface of the mid sole.

5. A shoe sole according to claim 4, wherein:

the compressively deformable member is sandwiched between the first main mid sole and the second main mid sole.

6. A shoe sole according to claim 1, wherein:

the groove is defined in the width direction of the foot without crossing an entire width of the second main mid sole in the width direction.

7. A shoe sole according to claim 1, wherein the second main mid sole forms other one or more pairs of surfaces in one of the medial edge and the lateral edge of the second main mid sole, the other one or more pairs of surfaces defining other one or more grooves extending in the width direction of the foot, each pair of surfaces of the other one or more pairs of surfaces comprising a front vertical surface and a back vertical surface of a corresponding groove of the other one or more grooves.

8. A shoe sole according to claim 1, wherein the second main mid sole forms another pair of surfaces in other one of the medial edge and the lateral side of the second main mid sole, the another pair of surfaces comprising a front vertical surface and a back vertical surface of another groove, each of the medial edge and the lateral edge of the second main mid sole having at least one corresponding groove.

9. A shoe sole according to claim 1, wherein second main mid sole forms a plurality of pairs of surfaces in each of the medial edge and the lateral edge of the second main mid sole that define a plurality of grooves, each pair of surfaces comprising a front vertical surface and a back vertical surface that define a corresponding groove of the plurality of grooves, the plurality of pairs of surfaces including the pair of surfaces, the plurality of grooves including the groove.

10. A shoe sole, comprising: a mid sole for absorbing an impact of landing, and an outer sole attached to a lower surface of the mid sole so as to be in contact with ground, wherein:

the mid sole includes a main mid sole of a foamed resin, and a compressively deformable member exposed on a side surface or a back surface of the mid sole;

the compressively deformable member accumulating a replusive force while being deformed and having a property selected from the group consisting of: being comprised of a rubber elasticity, and formed in a shape that is filled with a substance seleceted from the group consisting of: air, a gel substance, and a soft elastic member;

a holding member is provided for holding, in cooperation with the main mid sole, the compressively deformable member in a predetermined area;

the main mid sole includes a first main mid sole placed below a bottom portion of a foot, and a second main mid sole placed below the first main mid sole;

the compressively deformable member is sandwiched between the first main mid sole and the second main mid sole; and the holding member includes an attachment portion secured to a lower surface of the second main mid sole, and an engagement portion extending upwardly from the attachment portion on the side surface of the mid sole and engaging with a side surface of the compressively deformable member, the engagement portion being in a direct contact with the side surface of the compressively deformable member to cover the compressively deformable member.

11. A shoe sole according to claim 10, wherein the second main mid sole is provided in a front foot portion, and the compressively deformable member is located both in a medial area and a lateral area of the front foot portion.

12. A shoe sole according to claim 10, wherein the compressively deformable member is provided at a position of a ball of a big toe of a front foot portion.

13. A shoe sole according to claim 10, wherein the engagement portion is engaged with the second main mid sole.

14. A shoe sole according to claim 10, wherein the engagement portion is formed by a non-foamed resin.

15. A shoe sole according to claim 10, wherein:

the first main mid sole comprises a single plate-like member continuously extending from a medial edge of the mid sole to a lateral edge of the mid sole;

the second main mid sole has a plate-like shape;

the second main mid sole forms a pair of surfaces extending from the medial or lateral edge of the second main mid sole towards a central portion in a width direction of the foot, the pair of surfaces facing each other in the front-rear direction;

the pair of surfaces define a groove extending in the width direction of the foot.

16. A shoe sole according to claim 15, wherein:

the groove is defined without completely crossing the second main mid sole in the width direction of the foot.

17. A shoe sole, comprising:

a mid sole for absorbing an impact of landing, an outer sole placed under the mid sole so as to be in contact with ground, and a reinforcement element for suppressing bending of a front foot portion of the outer sole and a front foot portion of the mid sole during push-off, wherein:

the front foot portion of the outer sole includes a plurality of first portions spaced apart from one another at least in a front-rear direction of a foot;

the mid sole includes a first main mid sole formed by a single plate-like foamed resin continuously extending from a medial edge of the mid sole to a lateral edge of the mid sole, and a second main mid sole formed by a plate-like foamed resin and placed below the first main mid sole, the second main mid sole forms a pair of surfaces extending from one of the medial edge and the lateral edge of the second main mid sole toward a central portion in a width direction of the foot, the pair of surfaces facing each other in the front-rear direction, the pair of surfaces extending from one of the medial edge and the lateral edge of the second main mid sole toward the central portion defines a groove, the pair of surfaces comprising a front vertical surface and a back vertical surface of the groove;

the front foot portion of the second main mid sole includes a plurality of second portions spaced apart from one another by the groove extending in the width direction of the foot so as to break continuity of deformation at least in the front-rear direction of the foot, the plurality of second portions are each placed in both a medial side and a lateral side of the foot in the front foot portion, and at least one part of each of the second portions in the medial side is continuous with, in the width direction, at least one part of each of the second portions in the lateral side via the second main mid sole, via a part where the at least one part of each of the second portions in the medial side is continuous with the at least one part of each of the second portions in the lateral side, the second portions are continuous with each other in the front-rear direction in at least a part of a central portion except the groove;

the reinforcement element includes a plurarity of third portions attached to an upper surface of the outer sole and sandwiched between the first portions and the second portions; and the reinforcement element includes a bending suppressing portion placed and extending between the third portions in the front-rear direction of the foot, thereby serving to suppress the bending.

18. A shoe sole according to claim 17, wherein the reinforcement element is spaced apart from a lower surface of the second main mid sole between the first portions.

19. A shoe sole according to claim 17, wherein the reinforcement element is attached to a lower surface of the second main mid sole and curved in an upwardly protruding shape between the first portions.

20. A shoe sole according to claim 17, wherein:

the mid sole further includes a compressively deformable member exposed on a side surface of the mid sole;

the reinforcement element serves also as a holding member for holding, in cooperation with the first and second main mid soles, the compressively deformable member in a predetermined area; and the holding member includes an attachment portion secured to an upper surface of the outer sole, and an engagement portion extending upwardly from the attachment portion on the side surface of the mid sole.

21. A shoe sole according to claim 20, wherein:

the compressively deformable member is sandwiched between the first main mid sole and the second main mid sole.

22. A shoe sole according to claim 17, wherein:

the groove is defined without completely crossing the second main mid sole in the width direction of the foot.

* * * * *